US008500460B2

(12) United States Patent
Huang et al.

(10) Patent No.: US 8,500,460 B2
(45) Date of Patent: Aug. 6, 2013

(54) BOARD TO BOARD CONNECTORS AND ASSEMBLY THEREOF WITH CONTACT-MOUNTING WALL HAVING VARIABLE THICKNESS

(75) Inventors: Yung Mao Huang, Shulin (TW); Po Lin Chang, Shulin (TW)

(73) Assignee: Assem Technology Co., Ltd., Shulin, Taipei County (TW)

( * ) Notice: Subject to any disclaimer, the term of this patent is extended or adjusted under 35 U.S.C. 154(b) by 0 days.

(21) Appl. No.: 13/252,079

(22) Filed: Oct. 3, 2011

(65) Prior Publication Data

US 2013/0084717 A1 Apr. 4, 2013

(51) Int. Cl.
*H01R 12/00* (2006.01)

(52) U.S. Cl.
USPC ..... 439/74

(58) Field of Classification Search
USPC ..... 439/74, 357, 352, 627, 567–570
See application file for complete search history.

(56) References Cited

U.S. PATENT DOCUMENTS 7,717,719 B2 * 5/2010 Miyazaki et al. ..... 439/74
7,985,099 B2 * 7/2011 Wu ..... 439/626
8,052,457 B2 * 11/2011 Miyazaki et al. ..... 439/357
8,092,232 B2 * 1/2012 Takeuchi ..... 439/74

* cited by examiner

*Primary Examiner* — Jean F Duverne
(74) *Attorney, Agent, or Firm* — Cheng-Ju Chiang

(57) ABSTRACT

A board to board connector includes a connector housing and a number of contacts mounted to the connector housing. The connector housing includes a base and a pair of side walls extending from the base along a vertical direction. Each side wall includes a number of first mounting walls and a plurality of second mounting walls alternatively arranged along a longitudinal direction perpendicular to the vertical direction. The contacts are fixed to the first mounting walls and each contact is positioned by the adjacent two second mounting walls along the longitudinal direction. A thickness of each second mounting wall is variable along the vertical direction for avoiding irrecoverable deformation or damage thereof.

14 Claims, 5 Drawing Sheets

BOARD TO BOARD CONNECTORS AND ASSEMBLY THEREOF WITH CONTACT-MOUNTING WALL HAVING VARIABLE THICKNESS

BACKGROUND OF THE INVENTION

1. Field of the Invention

The present disclosure relates to board to board connectors and an assembly thereof, and more particularly to board to board connectors and an assembly thereof with improved contact-mounting walls having variable thickness for avoiding damage when a socket connector and a plug connector are mated with each other.

2. Description of Related Art

A pair of board to board connectors are used for establishing electrical connection between two circuit boards. Usually, a pair of board to board connectors include a socket connector (female connector) and a plug connector (male connector) mounted on two circuit boards, respectively. Conventional sock connectors and plug connectors each include a connector housing and a plurality of contacts fixed to the connector housing. The connector housing includes a peripheral wall on its long side for mounting the contacts. However, the thickness of the peripheral wall on the long side is invariable. When the socket connector and the plug connector are mated, the connector housings thereof are engaging against with each other, which will render the connector housings out of their elastic recover range and broken.

Hence, it is desirable to provide board to board connectors and an assembly thereof with improved contact-mounting walls for avoiding irrecoverable deformation or damage when a socket connector and a plug connector are mated.

BRIEF SUMMARY OF THE INVENTION

The present disclosure provides a board to board connector including a connector housing and a plurality of contacts mounted to the connector housing. The connector housing includes a base and a pair of side walls extending from the base along a vertical direction. Each side wall includes a plurality of first mounting walls and a plurality of second mounting walls alternatively arranged along a longitudinal direction perpendicular to the vertical direction. The contacts are fixed to the first mounting walls and each contact is positioned by the adjacent two second mounting walls along the longitudinal direction. A thickness of each second mounting wall is variable along the vertical direction for avoiding irrecoverable deformation or damage thereof.

The foregoing has outlined rather broadly the features and technical advantages of the present disclosure in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present disclosure, and the advantages thereof, reference is now made to the following descriptions taken in conjunction with the accompanying drawings, in which.

DETAILED DESCRIPTION OF THE PREFERRED EMBODIMENTS

Figure 1:
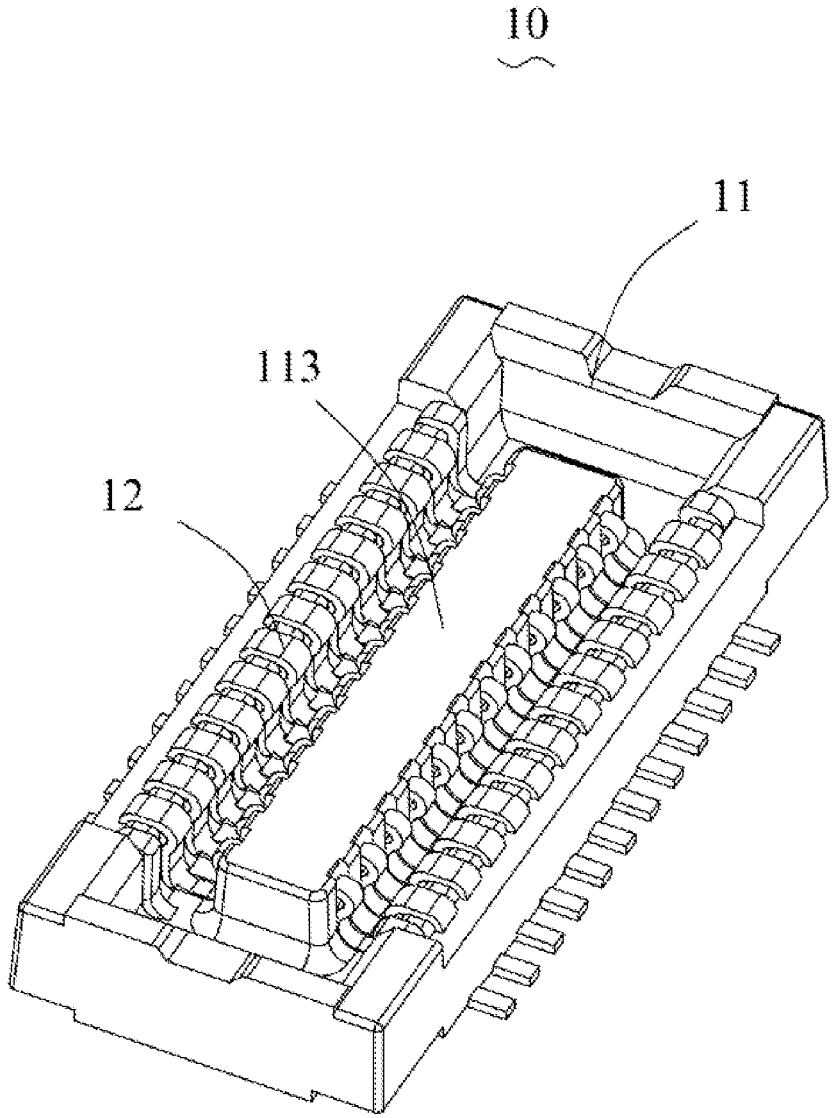
FIG. 1 is a perspective view of a socket connector in accordance with a preferred embodiment of the present disclosure.
Figure 5:
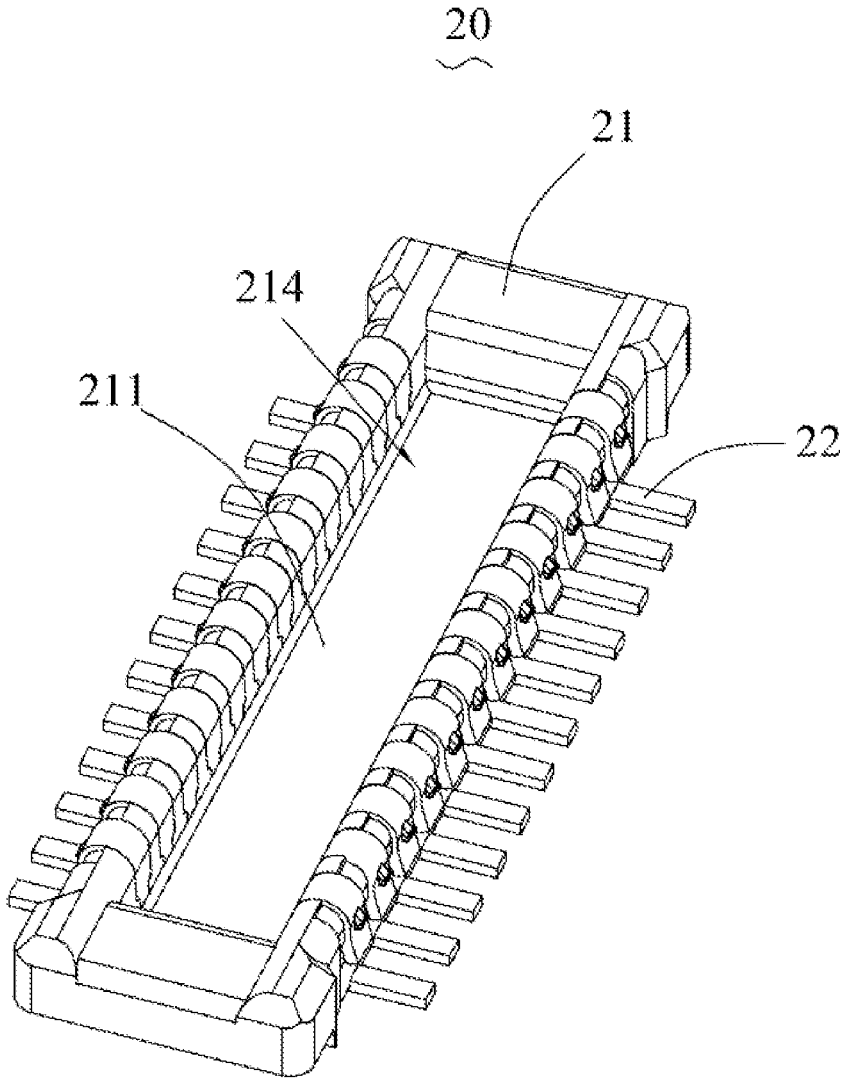
FIG. 5 is a perspective view of a plug connector for mating with the socket connector in accordance with a preferred embodiment of the present disclosure.

Reference will now be made to the drawing figures to describe the preferred embodiment of the present disclosure in detail. The illustrated embodiment of the present disclosure discloses a board to board connector assembly including a socket connector 10 (as shown in FIG. 1) and a plug connector 20 (as shown in FIG. 5) for mating with the socket connector 10. The socket connector 10 and the plug connector 20 are adapted for being soldered onto two parallel circuit boards (not shown) respectively, so as to establish electrical connection between the separate circuit boards. It is understood to those of ordinary sill in the art that both the socket connector 10 and the plug connector 20 can be regarded as a board to board connector.

Referring to FIGS. 1 to 4, the socket connector 10 includes a socket housing 11 and a plurality of socket contacts 12 received in the socket housing 11. The socket contacts 12 can be fixed to the socket housing 11 via assembly process or insert molding process.

Figure 2:
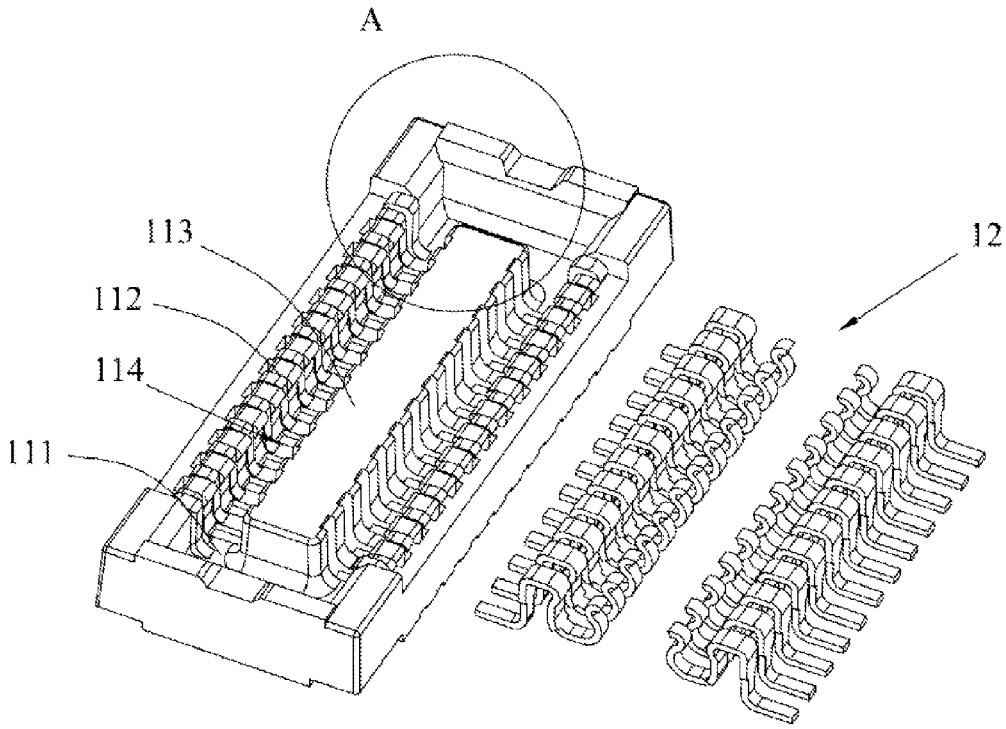
FIG. 2 is an exploded view of the socket connector as shown in FIG. 1 with socket contacts separated from the socket housing.

Referring to FIG. 2, the socket housing 11 includes a socket base 111 on bottom side thereof, a pair of opposite side walls 112 protruding upwardly from the socket base 111 along a vertical direction, and a middle island 113 protruding upwardly from the socket base 111 along the vertical direction as well. The pair of side walls 112 are located on two long sides of the socket housing 11 and each extend substantially along a longitudinal direction. The middle island 113 is located between the pair of side walls 112 so as to form a pair of longitudinal slots 114 on lateral sides of the middle island 113 for receiving the plug connector 20. The middle island 113 includes two rows of contact-receiving slots 1131 on the lateral sides and a plurality of separate blocks 1132 between each adjacent two contact-receiving slots 1131 along the longitudinal direction. The separate blocks 1132 are adapted for positioning the socket contacts 12 and preventing the adjacent socket contacts 12 contacting with each other. The contact-receiving slots 1131 are in communication with corresponding longitudinal slots 114. Each contact-receiving slot 1131 extends upwardly through a top surface of the middle island 113 for receiving distal ends of the socket contacts 12.

Figure 4:
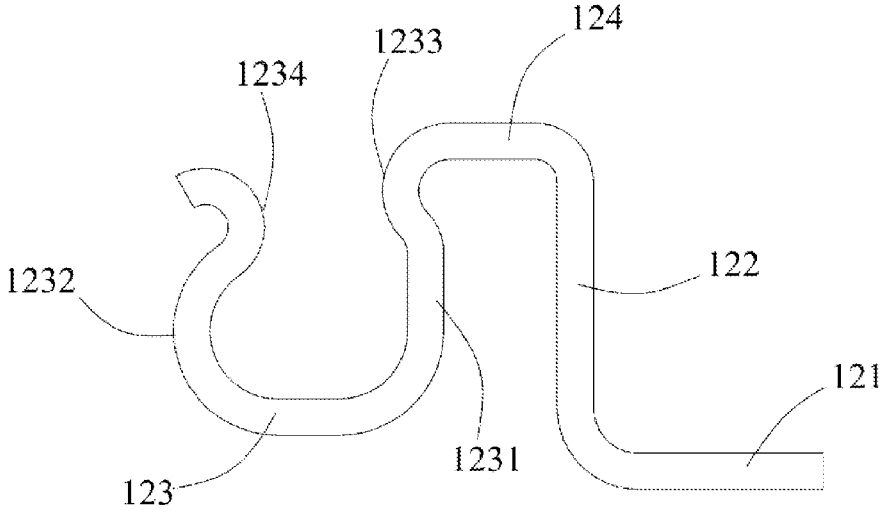
FIG. 4 is a side view of the socket contact.

Referring to FIG. 4, according to the illustrated embodiment of the present disclosure, each socket contact 12 is stamped to form a unitary piece and the socket contacts 12 are fixed to the socket housing 11 via insert molding technology. The socket contacts 12 are arranged in two rows on the lateral sides of the middle island 113 and are symmetrical with each other along the middle island 113. Each socket contact 12 has the same configuration and includes a horizontal soldering portion 121, a fixation portion 122 extending upwardly from the soldering portion 121 along the vertical direction, a horizontal connecting portion 124 extending sidewardly from a top end of the fixation portion 122 opposite to the soldering portion 121, and a substantially U-shaped contacting arm 123 extending downwardly from the connecting portion 124. The contacting arm 123 includes a fixed section 1231 with a fixed engaging protrusion 1233 extending into the longitudinal slot 114, and a movable section 1232 with a movable engaging protrusion 1234 extending into the longitudinal slot 114 towards the fixed engaging protrusion 1233. The movable engaging protrusion 1234 of each socket contact 12 is received in the corresponding contact-receiving slots 1131. The fixation portion 122 of each socket contact 12 is insert molded into the socket housing 11 so that the socket contacts 12 can be fixed in the socket housing 11. When the plug connector 20 is received in the longitudinal slots 114, both the fixed engaging protrusion 1233 and movable engaging protrusion 1234 are engaging with the plug connector 20 to achieve multi-point contact.

Figure 3:
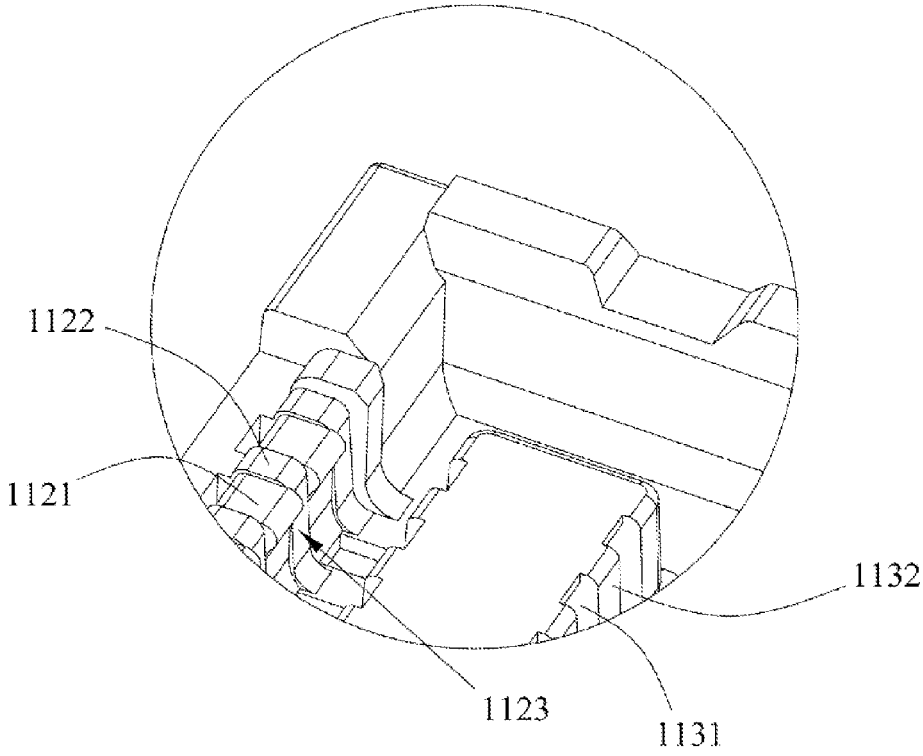
FIG. 3 is an enlarged view of the circle portion designated A as shown in FIG. 2.

Referring to FIG. 3, each side wall 112 includes a first mounting wall 1121 and a second mounting wall 1122 alternatively arranged along the longitudinal direction. The first mounting wall 1121 and the second mounting wall 1122 are arranged face to face with respect to the contact-receiving slots 1131 and the separate blocks 1132, respectively. The fixation portion 122, the connecting portion 124 and the fixed section 1231 cover the peripheral surface of the first mounting wall 1121. The thickness of the second mounting wall 1122 is variable along the vertical direction to better endure the stress and avoid irrecoverable deformation or damage thereof when the socket connector 10 and the plug connector 20 are mated. According to the illustrated embodiment of the present disclosure, the thickness of the second mounting wall 1122 is tapered from a bottom side to a top side along the vertical direction. Selectively, the thickness of the second mounting wall 1122 can be contracted in its middle section. That is to say, the thickness of the middle section is narrower than either the top section or the bottom section. The second mounting wall 1122 includes a slope surface 1123 adjacent to and exposed to the corresponding longitudinal slot 114. The slope surface 1123 can be a curved surface or a flat surface. Besides, another surface (not labeled) of the second mounting wall 1122 opposite to the slope surface 1123 can be also set as a curved surface or a flat surface. In this way, it is easier to avoid stress between the side wall 112 of the socket housing 11 and the plug connector 20, and the socket contacts 12 is fixed in the socket housing 11 reliably.

A top surface of the first mounting wall 1121 is coplanar with the top surface of the middle island 113 as a result that the height of the first mounting wall 1121 can be maximally enhanced while not increasing the height of the whole socket connector 10. Comparing with the top surface of the first mounting wall lower than the top surface of the middle island in the conventional connector, the fixation portion 122 of the present disclosure can be designed with greater height so as to be much stably fixed in the socket housing 11. Besides, under this condition, even if the profile of the socket connector 10 is not enlarged, the movable section 1232 can be of highest dimension. As a result, robust elastic force of the movable section 1232 can be achieved to improve retention force of the socket connector 10 and the plug connector 20 when they are mated. However, in alternative embodiments, the top surface of the first mounting wall 1121 can be set higher than the top surface of the middle island 113. The second mounting wall 1122 is higher than the first mounting wall 1121 so that a height difference therebetween is formed. When the socket contacts 12 are mounted onto the first mounting walls 1121, the contacting arms 123 of the socket contacts 12 can be restricted by adjacent second mounting walls 1122 for preventing the adjacent socket contacts 12 contacting with each other. Besides, a top surface of the connecting portion 124 is higher than the second mounting wall 1122.

The socket housing 11 can be integrally formed or insert molded by a first housing and a second housing. Under the insert molded fabrication, the socket base 111 and the middle island 113 are formed on the first housing, and the side walls 112 are set on the second housing. In fabrication, the first housing is firstly formed and is then put into a predetermined mold, the socket contacts 12 are then put onto the first housing with the movable engaging protrusions 1234 corresponding to the contact-receiving slots 1131, and the second housing is insert molded with the first housing and the socket contacts 12, ultimately. The socket connector 10 is finally achieved as shown in FIG. 1 with the socket contacts 12 stably fixed in the socket housing 11.

Figure 6:
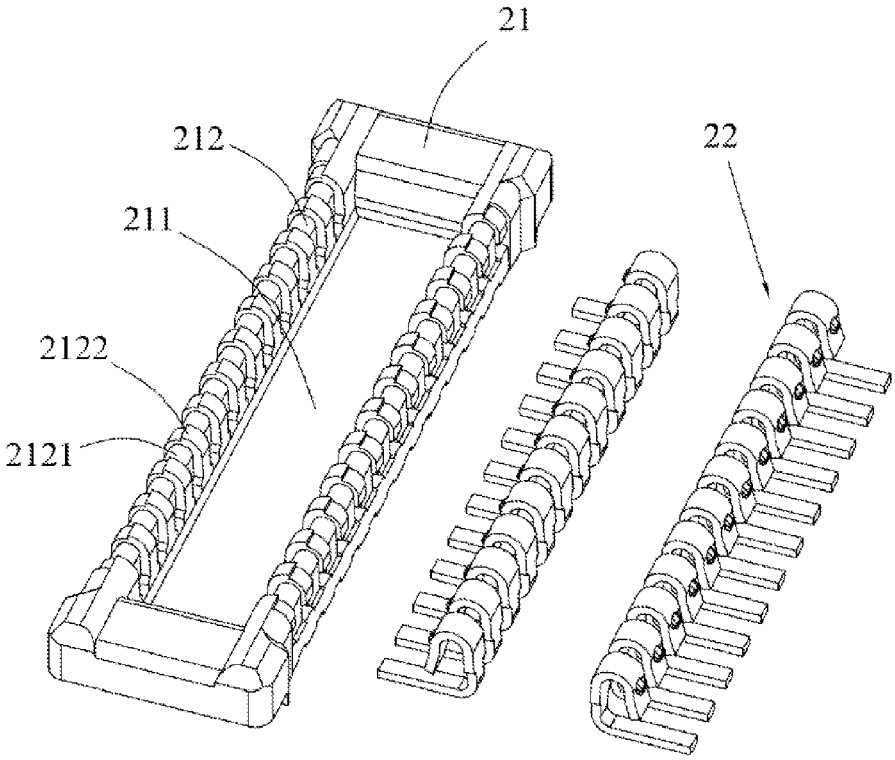
FIG. 6 is an exploded view of the plug connector as shown in FIG. 5 with plug contacts separated from the plug housing.
Figure 7:
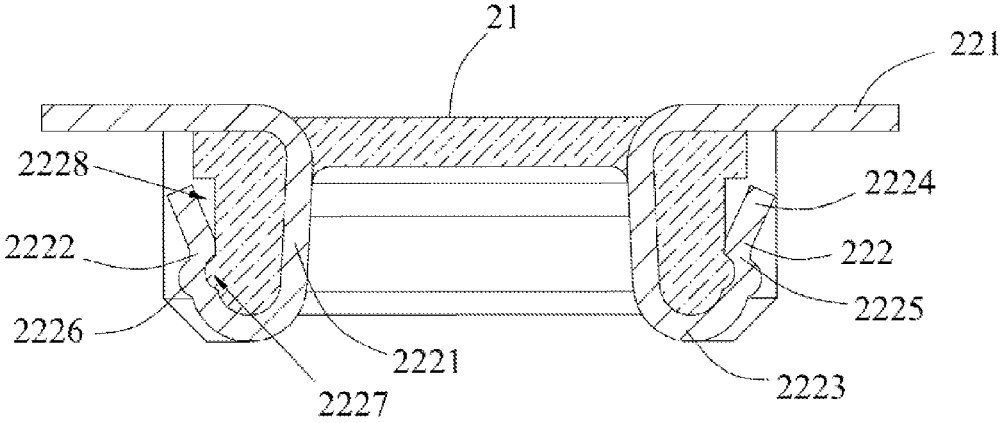
FIG. 7 is a cross-sectional view of the plug connector.

Referring to FIGS. 5 to 7, the plug connector 20 includes a plug housing 21 and a plurality of plug contacts 22 received in the plug housing 21. The plug contacts 22 can be fixed to the plug housing 21 via assembly process or insert molding process.

The plug housing 21 includes a plug base 211 and a pair of opposite side walls 212 extending upwardly from the plug base 211. A receiving slot 214 is formed between the side walls 212 for receiving the middle island 113 of the socket housing 11. The pair of side walls 212 are located on two long sides of the plug housing 21 and each extend substantially along the longitudinal direction. Each side wall 212 includes a plurality of first mounting sections 2121 and a plurality of second mounting sections 2122 alternatively arranged along the longitudinal direction. The plug contacts 22 are mounted on the peripheral surfaces of the first mounting sections 2121.

The thickness of each second mounting section 2122 is variable along the vertical direction for avoiding irrecoverable deformation or damage thereof when the socket connector 10 and the plug connector are mated. According to the illustrated embodiment of the present disclosure, the thickness of the second mounting section 2122 is tapered from a bottom side to a top side along the vertical direction. Selectively, the thickness of the second mounting section 2122 can be contracted in its middle section. That is to say, the thickness of the middle section is narrower than either the top section or the bottom section. The second mounting section 2122 includes a slope surface which can be a curved surface or a flat surface or other irregular surface. The second mounting section 2122 is higher than the first mounting section 2121 so that a height difference therebetween is formed. When the plug contacts 22 are mounted onto the first mounting sections 2121, they can be positioned by adjacent second mounting sections 2122 for preventing the adjacent plug contacts 22 contacting with each other.

The plug contacts 22 are arranged in two rows and are symmetrical with each other along the receiving slot 214. Referring to FIG. 7, each plug contact 22 has the same configuration and includes a horizontal soldering portion 221 and a U-shaped contacting portion 222 bent from an end of the soldering portion 221. The contacting portion 222 includes a first contacting section 2221 exposed to the receiving slot, a second contacting section 2222 opposite to the first contacting section 2221, and a connecting section 2223 connecting the first and the second contacting sections 2221, 2222. The second contacting section 2222 includes a first part 2225 extending from the connecting section 2223 and a second part 2224 slantways extending outwardly from the first part 2225. The second part 2224 is located at a distal end of the second contacting section 2222 and inclines along a direction lapsing from the first contacting section 2221. Besides, each first mounting section 2121 defines a space 2228 in which the second part 2224 deformable and movable, in an alternative embodiment, the second part 2224 can be formed integrally with plug housing 21 to be undeformable and no space is provided between the second part 2224 and the mounting section 2121. The second part 2224 extends beyond the corresponding side wall 212 and toward the soldering portion 221. The second part 2224 inclines upwardly and outwardly in a predetermined angle. During the plug contact 22 mating with the socket contact 12, an extrusion force occurs via the socket contact 12 pressing against the second part 2224. Such extrusion force drives the second part 2224 inwardly deformable and movable in the space 2228. As a result, when the plug contact 22 ultimately engages with the socket contact 12, a robust hold force can be achieved so as to improve retention force between the socket connector 10 and the plug connector 20. The first part 2225 is stamped outwardly to form a projection 2226 and leave a recess 2227 opposite to the projection 2226. In manufacture, the plug housing 21 fills in the recess 2227 so as to stably hold the second contacting section 2222. The projection 2226 can be formed as a dimple or a strip rib to contact with the fixed engaging protrusions 1233.

When the socket connector 10 and the plug connector 20 are mated, the side walls 212 of the plug connector 20 are received in the longitudinal slots 114 of the socket connector 10, and the middle island 113 are simultaneously received in the receiving slot 214. Under this condition, the U-shaped contacting portions 222 of the plug contacts 22 are received in the corresponding U-shaped contacting arms 123 of the socket contacts 12 with the first contacting sections 2221 engaging with the movable engaging protrusions 1234 and the second contacting sections 2222 engaging with the fixed engaging protrusions 1233 so as to establish electrical connection therebetween.

It is to be understood, however, that even though numerous, characteristics and advantages of the present disclosure have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. A board to board connector comprising:

a connector housing comprising a base and a pair of side walls extending from the base along a vertical direction, each side wall comprising a plurality of first mounting walls and a plurality of second mounting walls alternatively arranged along a longitudinal direction perpendicular to the vertical direction; and a plurality of contacts fixed to the first mounting walls, each contact being positioned by the adjacent two second mounting walls along the longitudinal direction; wherein a thickness of each second mounting wall is variable along the vertical direction;

wherein the connector housing defines a receiving slot, the second mounting wall defining a slope surface adjacent to and exposed to the receiving slot, the slope surface being a curved surface or a flat surface; and wherein the receiving slot is formed between the side walls, each contact comprising a first contacting section exposed to the receiving slot, a second contacting section opposite to the first contacting section and a connecting section connecting the first and the second contacting sections, the second contacting section comprising a slant distal end extending along a direction lapsing from the first contacting section and beyond the first mounting wall.

2. The board to board connector as claimed in claim 1, wherein the second mounting wall is higher than the first mounting wall so that a height difference is formed between the adjacent first and second mounting walls along the longitudinal direction, the contact being restricted by the height difference.

3. The board to board connector as claimed in claim 1, wherein the thickness of the second mounting wall is tapered along the vertical direction.

4. The board to board connector as claimed in claim 1, wherein the thickness of the second mounting wall is contracted in its middle section.

5. The board to board connector as claimed in claim 1, wherein the connector housing comprises a middle island protruding from the base along the vertical direction, the middle island being located between the pair of side walls so as to form a pair of the receiving slots on lateral sides of the middle island, a top surface of the first mounting wall being no lower than a top surface of the middle island.

6. The board to board connector as claimed in claim 1, wherein the second contacting section is stamped outwardly to form a projection and leave a recess opposite to the projection, the connector housing filling in the recess.

7. The board to board connector as claimed in claim 1, wherein the first mounting wall defines a space in which the slant distal end is movable.

8. The board to board connector as claimed in claim 1, wherein the connector housing comprises a first housing and a second housing insert molded with the first housing, the contacts being mounted onto the first mounting walls.

9. A board to board connector assembly comprising:

a socket connector and a plug connector for mating with the socket connector, the socket connector comprising:

a socket housing comprising a socket base, a pair of side walls extending from the socket base along a vertical direction, and a middle island located between the side walls so as to form a pair of longitudinal slots, each side wall comprising a plurality of first mounting walls and a plurality of second mounting walls alternatively arranged along a longitudinal direction perpendicular to the vertical direction; and a plurality of socket contacts fixed to the first mounting walls and extending into the corresponding longitudinal slots;

the plug connector comprising:

a plug housing comprising a plug base and a pair of side walls extending from the plug base along the vertical direction, the side walls of the plug housing being received in the longitudinal slots and each side wall comprising a plurality of first mounting sections and a plurality of second mounting sections alternatively arranged along the longitudinal direction; and a plurality of plug contacts fixed to the first mounting sections for engaging with the socket contacts; wherein a thickness of either each second mounting wall or each second mounting section is variable along the vertical direction; and wherein the second mounting wall defines a slope surface adjacent to and exposed to the corresponding longitudinal slot, the slope surface being a curved surface or a flat surface; and wherein the plug housing defines a receiving slot between the side walls to receive the middle island, the second mounting section defining another slope surface adjacent to and exposed to the receiving slot, the another slope surface being a curved surface or a flat surface.

10. The board to board connector assembly as claimed in claim 9, wherein the thickness of each second mounting wall is variable along the vertical direction, and the thickness of each second mounting section is variable along the vertical direction as well.

11. The board to board connector assembly as claimed in claim 9, wherein the second mounting wall is higher than the first mounting wall, and the second mounting section is higher than the first mounting section.

12. The board to board connector assembly as claimed in claim 9, wherein the thicknesses of the second mounting wall and the second mounting section are tapered along the vertical direction.

13. The board to board connector assembly as claimed in claim 9, wherein the thicknesses of the second mounting wall and the second mounting section are contracted in their middle sections, respectively.

14. The board to board connector assembly as claimed in claim 9, wherein a top surface of the first mounting wall is no lower than a top surface of the middle island.

* * * * *